United States Patent [19]

Jones

[11] Patent Number: 4,945,991

[45] Date of Patent: Aug. 7, 1990

[54] METHOD FOR GRAVEL PACKING WELLS

[75] Inventor: Lloyd G. Jones, Dallas, Tex.

[73] Assignee: Mobile Oil Corporation, New York, N.Y.

[21] Appl. No.: 397,217

[22] Filed: Aug. 23, 1989

[51] Int. Cl.[5] ..... E21B 43/04

[52] U.S. Cl. ..... 166/278; 166/51

[58] Field of Search ..... 166/278, 276, 51, 115, 166/116, 191

[56] References Cited

U.S. PATENT DOCUMENTS

| | | | |
|---|---|---|---|
| 2,755,861 | 7/1956 | Smet | 166/51 X |
| 3,421,586 | 1/1969 | Solum | 166/51 |
| 3,482,627 | 12/1969 | Nebolsine | 166/51 |
| 4,558,742 | 12/1985 | Huang et al. | 166/278 |

*Primary Examiner*—William P. Neuder

*Attorney, Agent, or Firm*—Alexander J. McKillop; Charles J. Speciale; George W. Hager, Jr.

[57] ABSTRACT

A method for gravel packing a well penetrating an unconsolidated or poorly consolidated subterranean oil or gas reservoir. The well employs a borehole casing with perforation tunnels for fluid communication between the borehole casing and a substantial portion of the reservoir. A sand screen is located inside the well casing and in juxtaposition with the perforation tunnels forming an annulus between the borehole casing and the sand screen. One or more conduits are positioned coaxially adjacent the exterior of the sand screen with openings to provide fluid communication between the conduit and a substantial portion of the annulus between the borehole casing and the sand screen. A slurry of gravel is injected down through the annulus between the borehole casing and the sand screen until the annulus is filled with gravel. If injection of the slurry of gravel forms a gravel bridge in any portion of the annulus being packed thereby plugging the annulus between the casing and the sand screen, the slurry of gravel will continue to flow down the conduit and into the annulus below the gravel bridge thereby completely packing the annulus between the sand screen and the borehole casing. The oil or gas in the reservoir is then produced through the gravel packed borehole casing and the sand screen. If desired, the slurry of gravel may be injected down the well and up the conduit and annulus to accomplish complete packing. The method is also applicable to placing gravel packs in an open-hole wellbore adjacent to a substantial portion of an unconsolidated or poorly consolidated subterranean oil or gas reservoir.

40 Claims, 3 Drawing Sheets

METHOD FOR GRAVEL PACKING WELLS

BACKGROUND OF THE INVENTION

This invention relates to a method for gravel packing a well that penetrates an unconsolidated or poorly consolidated subterranean oil or gas reservoir.

In the production of hydrocarbons from hydrocarbon-bearing unconsolidated formations, a well is provided which extends from the surface of the earth into the unconsolidated or poorly consolidated formation. The well may be completed by employing conventional completion practices, such as running and cementing casing in the well and forming perforations through the casing and cement sheath surrounding the casing, thereby forming an open production interval which communicates with the formation.

The production of hydrocarbons from unconsolidated or poorly consolidated formations may result in the production of sand along with the hydrocarbons. Produced sand is undesirable for many reasons. It is abrasive to components within the well, such as tubing, pumps and valves, and must be removed from the produced fluids at the surface. Further, it may partially or completely clog the well, thereby making necessary an expensive workover. In addition, the sand flowing from the formation may leave therein a cavity which may result in caving the formation and collapse of the casing.

A technique commonly employed for controlling the flow of sand from an unconsolidated or poorly consolidated formation into a well involves the forming of a gravel pack in the well adjacent part or all of the unconsolidated or poorly consolidated formation exposed to the well. Thereafter, hydrocarbons are produced from the formation through the gravel pack and into the well. Gravel packs have generally been successful in mitigating the flow of sand from the formation into the well.

One of the major problems associated with gravel packing, especially in gravel packing long or inclined intervals, arises from the difficulty in completing packing the annulus between the screen and the casing for in-casing gravel packs or between the screen and the side of the hole for open hole or under-reamed gravel packs. Incomplete packing is often associated with the formation of sand "bridges" in the interval to be packed which prevent placement of sufficient sand below that bridge, for top down gravel packing, or above that bridge, for bottom up gravel packing. In accordance with this invention the problem associated with bridge formation is circumvented by permitting separate pathways for sand laden slurry to reach locations above or below the sand bridge or bridges.

SUMMARY OF THE INVENTION

In accordance with the present invention, there is provided a method for gravel packing a well that penetrates an unconsolidated or poorly consolidated subterranean oil or gas reservoir, comprising:

(a) providing a borehole casing through said reservoir;

(b) perforating said casing at preselected intervals therealong to form at least one set of longitudinal, perforation tunnels adjacent a substantial portion of said reservoir;

(c) locating a sand screen inside the casing and in juxtaposition with said perforation tunnels, a annulus being formed between said sand screen and said casing;

(d) positioning a conduit coaxially adjacent said sand screen extending substantially the length of said sand screen and having its upper and lower extremity open to fluids or open at the top and sealed at its lower end to fluids, said conduit having openings at preselected intervals throughout a substantial portion of the conduit to establish fluid communication between the conduit and said annulus;

(e) injecting a fluid slurry containing gravel down through said annulus and conduit whereby the fluid portion of the slurry is forced out of said annulus through said perforation tunnels into said reservoir and the gravel portion of the slurry is deposited in said annulus and forced into the perforation tunnels into the formation;

(f) sizing the cross-sectional area of said conduit and said annulus so that if gravel forms a bridge in a portion of said annulus thereby blocking the flow of fluid slurry through the said annulus, fluid slurry containing gravel will continue to flow through the conduit and into the annulus around the gravel bridge; and (h) terminating the injection of said fluid slurry containing gravel when the said annulus is completely packed with gravel.

In another embodiment, the fluid containing gravel packing material may be injected down the well and up the annulus section between the sand screen and the borehole casing until the annular section has been completely packed.

The method is also applicable to open hole gravel packs for wells drilled in unconsolidated or poorly consolidated oil or gas producing formations.

DESCRIPTION OF THE PREFERRED EMBODIMENT

This invention is directed to a method for gravel packing a well for use in unconsolidated or poorly consolidated formations to control the production of sand from unconsolidated or poorly consolidated formations. More particularly, this invention is concerned with a method for preventing incomplete gravel packing associated with the formation of sand bridges in the annulus to be packed which prevents placement of sufficient gravel packing in the annulus below that bridge, for top down gravel packing, or above that bridge, for bottom up gravel packing.

Figure 1:
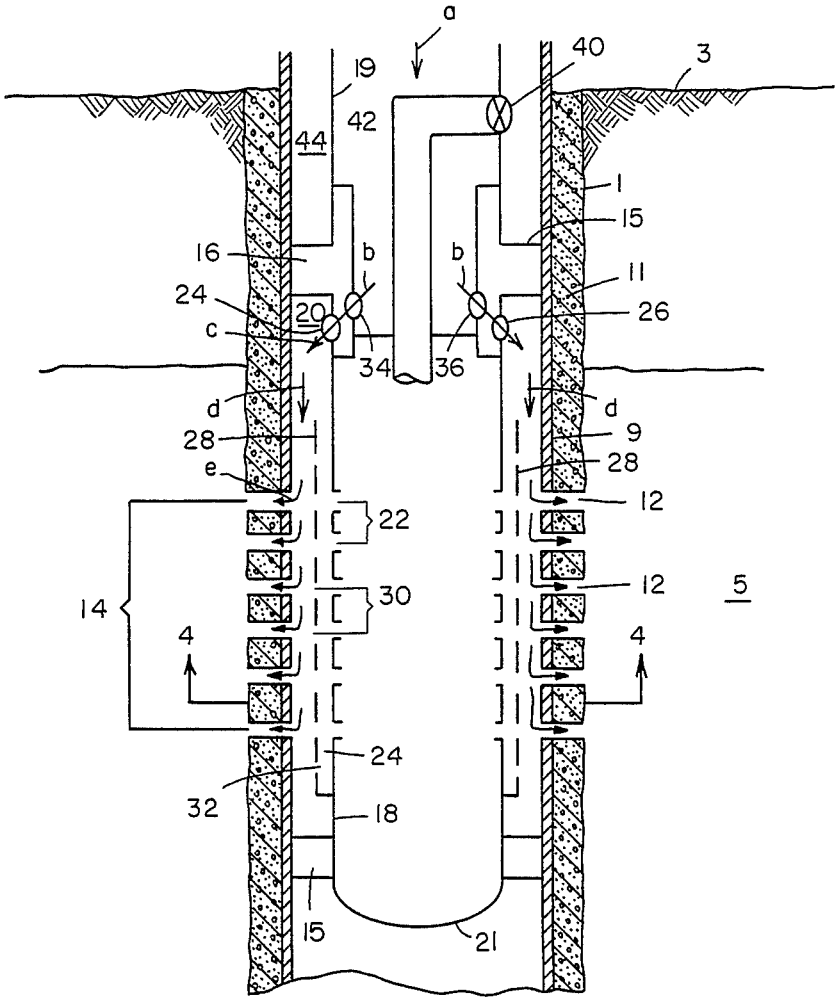
FIG. 1 is a diagramatic of a perforated well casing at a location of an unconsolidated or loosely consolidated formation illustrating the annular spaces and perforations in the well casing for carrying out the inside of the casing gravel packing method of the present invention.

Referring to FIG. 1, there is illustrated one embodiment of a well gravel packing operation useful in carrying out the method of the present invention. With reference to FIG. 1, there is illustrated a well 1 which extends from the surface of the earth 3 into an unconsolidated or poorly consolidated formation 5 containing oil or gas. Well 1 is equipped with a borehole casing 9 that is bonded to the walls of the well by a cement sheath 11. A plurality of perforation tunnels 12 extend through borehole casing 9 and cement sheath 11 at preselected intervals thereby forming an open production interval 14 that provides for fluid communication between the interval of well 1 and a substantial portion of the unconsolidated or poorly consolidated formation 5. The perforations tunnels 12 should have diameters between ⅛ and 1 inch or more, and extend vertically along the longitudinal axis of the borehole casing 9. Gravel packers 15 and 16 are set inside the casing 9 to isolate that portion of the well casing containing perforation tunnels 12 in communication with the oil or gas containing formation 5. A sand screen 18 is located inside borehole casing 9 and in juxtaposition with the perforated tunnels 12 to form an annular space 20 between the sand screen 18 and the borehole casing 9. Sand screen 18 comprises a continuous wrapping of wire ribbon (not shown) on the blank pipe 21 or a slotted liner, or other sand retaining devices. The purpose of the sand screen 18 is to allow fluid flow from the formation while preventing the movement of sand and gravel. With a wire wrapped screen, slots or holes 22 are first cut or drilled in the pipe 21 to allow fluid flow. Metal ribs (not shown) are welded longitudinally on the outside of the pipe 21. Then the wire ribbon is wrapped around the metal ribs in a helical pattern. This type of sand screen is conventional in the industry. Other conventional sand screens include slotted liners or prepacked liners. A typical sand screen is disclosed by Jennings in U.S. Pat. No. 4,664,191, which issued on May 12, 1987 and which is hereby incorporated by reference.

Sand screens generally are manufactured in lengths of 30 feet or less, corresponding to one joint of pipe. Spacing between the wire ribbons in the wire wrap or size of slots in a slotted liner depend on the sand or gravel size whose movement is to be prohibited. At least one inch of radial clearance is desirable between the sand screen and the casing 9. The blank pipe 21 usually extends above the wire ribbons.

The sand screen 18 is supported from a conventional gravel packer 16. Such a gravel packer serves two purposes. It controls the path of flow of the gravel packing sand into the annular space 20 between the sand screen 18 and the borehole casing 9 from a conventional cross-over tool 19 through the cross-over ports 24 and 26 during hydraulic fracturing and gravel packing and, along with the gravel packer 16, forms an isolating seal for the annular section 20 during oil or gas production from the reservoir. Other mechanical arrangements may be used to maintain a similar relationship between the formation 5, annular space 20 and sand screen 18.

Figure 4:
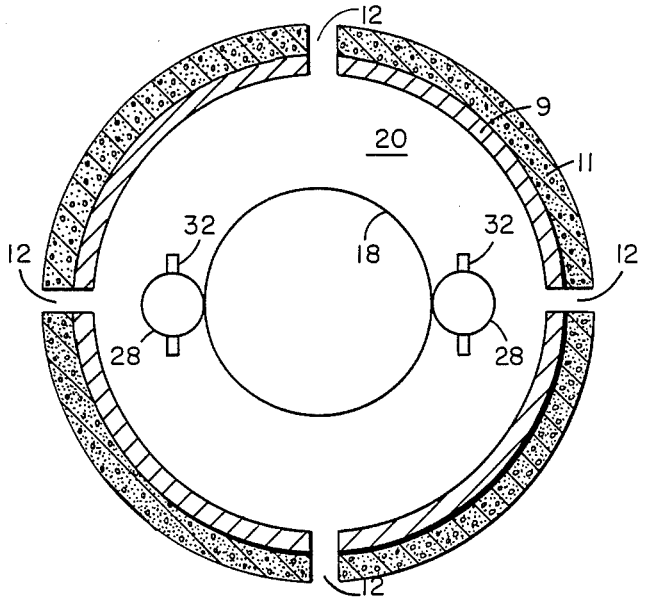
FIG. 4 is a cross-sectional view of the well completion taken along the lines 4—4 of FIG. 1 with the perforations in the separate channel extended.

In the embodiment of the invention shown in FIG. 1, one or more conduits 28 are mounted or incorporated into the screen in juxtaposition with the exterior of the sand screen 20. The conduit 28 is preferably secured to or is part of the sand screen 18 and is of sufficient size to permit the flow of sand or gravel slurry. The conduit 28 extends substantially throughout the distance of the annular space 20 to be gravel packed and can be open at both ends or open at the top and sealed at its lower end to fluids. Conduit 28 is provided with a plurality of openings or perforations 30 at preselected intervals therealong that extend the length thereof to establish fluid communication between conduit 28 and annular section 20. These perforations are sufficient in number and size to permit the flow of fluid containing gravel pack material from conduit 28 to annular section 20. In another embodiment, as illustrated in FIG. 4, the openings in conduit 28 may consist of lateral conduits 32 located throughout a substantial length of conduit 28 and open at the end to establish fluid communication between conduit 28 and annular section 20. Conduit 28 can consist of a pipe (either circular, square, rectangular, or curved, etc.) with perforations 30, or lateral conduits 32 to permit flow of slurry gravel pack into annular section 20. Although the conduit 28 may be made of any pressure-resistant material, it is preferably to be made of stainless steel.

Having now described one embodiment of a well completion useful in carrying out the method of the present invention, the use of such a well completion will now be described in conjunction with the gravel packing method of the present invention. Initially, the borehole casing 9 is cemented in place and perforated at preselected intervals to form at least one set of longitudinal perforation tunnels 12 that extend throughout a substantial portion of the formation 5. The sand screen 18 along with conduit 28 secured thereto or otherwise maintained in position is located inside such casing and in juxtaposition with the perforation tunnels 12 as shown in FIG. 1. Sand screen 18 is held in position by the gravel packer 16 and the sealed annular section 20 is provided between the two gravel packers 14 and 16. The sand screen 18 and conduit 28 extend throughout a substantial portion of the formation 5. The conduit 28 preferably begins at the top, somewhat above, even with, or slightly below the top of the sand screen 18. The conduit 28 preferably ends at the bottom, somewhat above, even with, or below the bottom of the sand screen 18.

Figure 2:
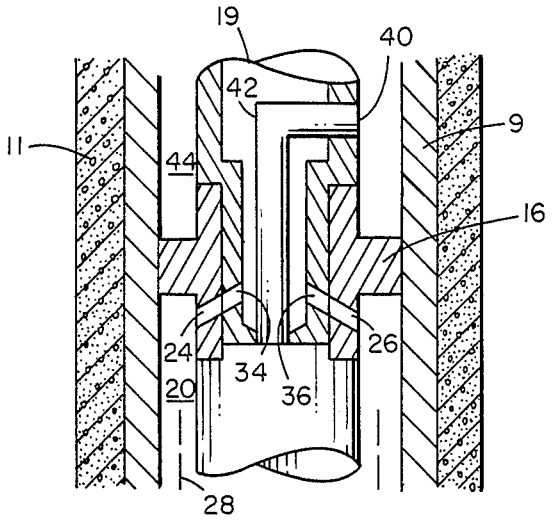
FIG. 2 is a partial cross-sectional view of a well completion for use inside the well casing of FIG. 1 for carrying out the inside of the casing gravel packing method of the present invention.

Referring now to FIG. 2, a slurry of gravel is injected down the well casing 9 through a work string (not shown) into the cross-over tool 19. The term gravel as used herein shall encompass hard, rigid particulate matter ranging in size from very fine sand to pebble size material having a size in the range of 8/12 to 250 mesh, preferably 40/60 mesh. The gravel pack slurry passes through cross-over ports 34 and 36 in the cross-over tool 19, which are in fluid communication with cross-over ports 24 and 26 in the gravel packer 16 and then into annular section 20. The conventional cross-over port 40 from the wash pipe 42 of cross-over tool 19 in fluid communication with annular section 44 above the gravel packer 16 is closed so as to inhibit the flow of gravel slurry from annular section 20 through the sand screen 18 and upward through the cross-over tool 19 into annular section 44. Consequently, all the gravel slurry is forced into annular section 20 and out the perforation tunnels 12 into the surrounding formation 5.

The gravel slurry is injected into the well until annular section 20 surrounding the sand screen 18 is filled with gravel. Referring to FIG. 1, the arrows a-e illustrate fluid flow paths during the gravel packing phase of the present invention. These fluid flow paths are as follows:

a; down the cross-over tool 19, b: through open cross-over ports 34 and 36 of cross-over tool 19, c: through open cross-over ports 24 and 26 of gravel packer 16, d: through annular section 20 and conduit 28, and e: through perforations 12 into the formation.

The fluid portion of the slurry could also pass through the sand screen 18 and into the wash pipe 42.

Figure 3:
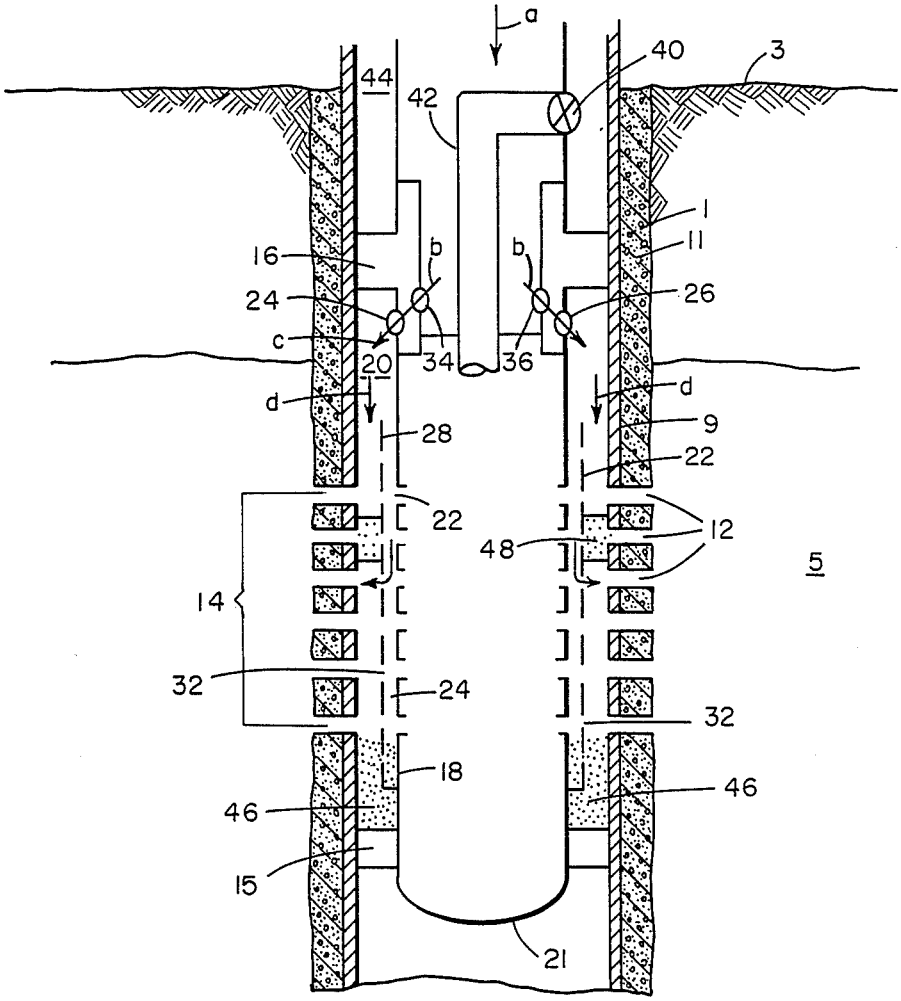
FIG. 3 is a diagramatic fluid flow pattern illustrating the formation of sand bridges and use of separate pathways to circumvent sand bridge formation.

As injection of the gravel slurry continues, a gravel pack 46 as shown in FIG. 3 begins to fill annular section 20 and conduit 28 from the bottom to the top. Due to non-uniformity in the permeability of the formation 5, the fluid portion of the gravel slurry will preferentially flow into the high permeability zones of the formation 5 and a bridge 48 of gravel may occur in the upper portion of annular section 20, thus essentially halting fluid flow through annular section 20. As soon as a gravel bridge 48 plugs annular section 20, the gravel slurry will continue to flow down through conduit 28, bypassing the gravel bridge 48 and flow out through perforations 22 in conduit 28 below the gravel bridge thereby allowing further placement of gravel packing sand in the annular section 20 below the sand bridge 48. By making the cross-sectional area of conduit 28 smaller than the cross-sectional area of annular section 20, the fluid velocity in conduit 28 will be greater than the fluid velocity in annular section 20 thereby preventing bridging of gravel within conduit 28. Lateral conduits 32 illustrated in FIG. 4 can also be used to decrease possibility of such bridging. No matter how many gravel bridges are formed in annular section 20, the flow of fluid containing gravel is diverted around the gravel bridges until the entire interval in annular space 20 is gravel packed. Thus, the entire annular space 20 is gravel packed using the separate flow channel concept.

Instead of injecting the gravel slurry down annular section 20 for packing, as described supra, the gravel pack slurry may be injected down the well and up the annular space 20 to be packed in accordance with gravel packing techniques known in the art. In this embodiment, conduit 28 will be open at both ends or opened at the lower end and sealed at its upper end to fluids.

In still another embodiment, all of the gravel or sand slurry may be pumped only through the conduit 28. By proper design of the perforations 22, the entire annular space 20 can be packed by using the perforations to divert gravel pack slurry along the entire interval to be packed. In this case, the annular space 20 could be essentially closed off except to flow from conduit 28.

After the gravel pack has been completed, oil or gas production may now be immediately carried out by removal of the cross-over tool 19 and replacement with conventional producing tubing. The fluid flow paths during the production phase is illustrated in U.S. Pat. No. 4,685,519 referenced above and which is hereby incorporated by reference. The gravel pack which is placed in the well around the sand screen 18 is sufficient to prevent migration of fines from the formation into the well. Placement of said gravel pack immobilizes the sand within the formation and overall fluid communication paths between the formation and the well bore for the production of oil or gas.

The method of the present invention is also applicable to placing a gravel pack in an open-hole wellbore drilled in an unconsolidated or poorly consolidated subterranean oil or gas reservoir as illustrated in U.S. Pat. No. 3,434,540 and which is hereby incorporated by reference. In this embodiment, a gravel pack is placed in the wellbore to rest against the wellbore in the formation so that fluid flowing from the formation passes through the gravel pack. Positioning a conduit or plurality of conduits in the annulus between the sand screen and the wellbore in accordance with the present invention, provides separate flow paths to permit gravel pack slurry to bypass sand bridges which might build up in the annulus between the sand screen and the wellbore.

Having thus described our invention, it will be understood that such description has been given by way of illustration and example and not by way of limitation, reference for the latter purpose being had to the appended claims.

I claim:

1. A method for gravel packing a well that penetrates an unconsolidated or poorly consolidated subterranean oil or gas reservoir, comprising:

(a) providing a borehole casing through said reservoir;

perforating said casing at preselected intervals therealong to form at least one set of longitudinal, perforation tunnels adjacent a substantial portion of said reservoir;

(c) locating a sand screen inside the casing and in juxtaposition with said perforation tunnels, an annulus being formed between said sand screen and said casing;

(d) positioning a conduit in juxtaposition with said sand screen extending substantially the length of said sand screen and having its upper extremity open to fluids, said conduit having openings at preselected intervals throughout a substantial portion of the conduit to establish fluid communication between the conduit and said annulus;

(e) injecting a fluid slurry containing gravel down through said annulus and conduit whereby the fluid portion of the slurry is forced out of said annulus through said perforation tunnels into said reservoir and the gravel portion of the slurry is deposited in said annulus and forced into the perforation tunnels into the formation;

(f) sizing the cross-sectional area of said conduit and said annulus so that if gravel forms a bridge in a portion of said annulus thereby blocking the flow of fluid slurry through the said annulus, fluid slurry containing gravel will continue to flow through the conduit and into the annulus around the gravel bridge; and terminating the injection of said fluid slurry containing gravel when the said annulus is completely packed with gravel.

2. The method of claim 1 wherein a plurality of conduits are attached to the sand screen.

3. The method of claim 1 wherein the conduit is sealed to fluids at its lower extremity.

4. The method of claim 1 wherein said openings in the conduit are perforations.

5. The method of claim 1 wherein said openings in the conduit are lateral extensions from the conduit.

6. A method for gravel packing a well that penetrates an unconsolidated or poorly consolidated subterranean oil or gas reservoir, comprising:

(a) providing a borehole casing through said reservoir;

(b) perforating said casing at preselected intervals therealong to form at least one set of longitudinal, perforation tunnels adjacent a substantial portion of said reservoir;

(c) locating a sand screen inside the casing and in juxtaposition with said perforation tunnels, an annulus being formed between said sand screen and said casing;

(d) positioning a conduit in juxtaposition with said sand screen extending substantially the length of said sand screen and having its lower extremity open to fluids, said conduit having openings at preselected intervals throughout a substantial portion of the conduit to establish fluid communication between the conduit and said annulus;

(e) injecting a fluid slurry containing gravel down the well and up through said annulus and conduit whereby the fluid portion of the slurry is forced out of said annulus through said perforation tunnels into said reservoir and the gravel portion of the slurry is deposited in said annulus and forced into the perforation tunnels into the formation;

(f) sizing the cross-sectional area of said conduit and said annulus so that if gravel forms a bridge in a portion of said annulus thereby blocking the flow of fluid slurry through the said annulus, fluid slurry containing gravel will continue to flow through the conduit and into the annulus around the gravel bridge; and (g) terminating the injection of said fluid slurry containing gravel when the said annulus is completely packed with gravel.

7. The method of claim 6 wherein a plurality of conduits are attached to the sand screen.

8. The method of claim 6 wherein said openings in the conduit are perforations.

9. The method of claim 6 wherein said openings in the conduit are lateral extensions from the conduit.

10. The method of claim 6 wherein the conduit is sealed at its upper extremity.

11. A method for gravel packing a well that penetrates an unconsolidated or poorly consolidated subterranean oil or gas reservoir, comprising:

(a) providing a borehole casing through said reservoir;

(b) perforating said casing at preselected intervals therealong to form at least one set of longitudinal, perforation tunnels adjacent a substantial portion of said reservoir;

(c) locating a sand screen inside the casing and in juxtaposition with said perforation tunnels, an annulus being formed between said sand screen and said casing;

(d) positioning a conduit in juxtaposition with said sand screen extending substantially the length of said sand screen and having its upper extremity open to fluids, said conduit having openings at preselected intervals throughout a substantial portion of the conduit to establish fluid communication between the conduit and said annulus;

(e) injecting a fluid slurry containing gravel down through said conduit whereby the fluid portion of the slurry is forced out of said annulus through said perforation tunnels into said reservoir and the gravel portion of the slurry is deposited in said annulus and forced into the perforation tunnels into the formation; and (f) terminating the injection of said fluid slurry containing gravel when the said annulus is completely packed with gravel.

12. The method of claim 11 wherein a plurality of conduits are attached to the sand screen.

13. The method of claim 11 wherein the conduit is sealed to fluids at its lower extremity.

14. The method of claim 11 wherein said openings in the conduit are perforations.

15. The method of claim 11 wherein said openings in the conduit are lateral extensions from the conduit.

16. A method for gravel packing a well that penetrates an unconsolidated or poorly consolidated subterranean oil or gas reservoir, comprising:

(a) providing a borehole casing through said reservoir;

(b) perforating said casing at preselected intervals therealong to form at least one set of longitudinal, perforation tunnels adjacent a substantial portion of said reservoir;

(c) locating a sand screen inside the casing and in juxtaposition with said perforation tunnels, an annulus being formed between said sand screen and said casing;

(d) positioning a conduit in juxtaposition with said sand screen extending substantially the length of said sand screen and having its lower extremity open to fluids, said conduit having openings at preselected intervals throughout a substantial portion of the conduit to establish fluid communication between the conduit and said annulus;

(e) injecting a fluid slurry containing gravel down through the well and up through said conduit whereby the fluid portion of the slurry is forced out of said annulus through said perforation tunnels into said reservoir and the gravel portion of the slurry is deposited in said annulus and forced into the perforation tunnels into the formation; and (f) terminating the injection of said fluid slurry containing gravel when the said annulus is completely packed with gravel.

17. The method of claim 16 wherein a plurality of conduits are attached to the sand screen.

18. The method of claim 16 wherein the conduit is sealed to fluids at its upper extremity.

19. The method of claim 16 wherein said openings in the conduit are perforations.

20. The method of claim 16 wherein said openings in the conduit are lateral extensions from the conduit.

21. A method for gravel packing a well that penetrates an unconsolidated or poorly consolidated subterranean oil or gas reservoir, comprising:

(a) providing a wellbore through said reservoir;

(b) locating a sand screen inside the wellbore and in juxtaposition with said wellbore, an annulus being formed between said sand screen and said wellbore;

(c) positioning a conduit in juxtaposition with said sand screen extending substantially the length of said sand screen and having its upper extremity open to fluids, said conduit having openings at preselected intervals throughout a substantial portion of the conduit to establish fluid communication between the conduit and said annulus;

(d) injecting a fluid slurry containing gravel down through said annulus and conduit whereby the fluid portion of the slurry is forced out of said annulus into said reservoir and the gravel portion of the slurry is deposited in said annulus;

(e) sizing the cross-sectional area of said conduit and said annulus so that if gravel forms a bridge in a portion of said annulus thereby blocking the flow of fluid slurry through the said annulus, fluid slurry containing gravel will continue to flow through the conduit and into the annulus around the gravel bridge; and (f) terminating the injection of said fluid slurry containing gravel when the said annulus is completely packed with gravel.

22. The method of claim 21 wherein a plurality of conduits are attached to the sand screen.

23. The method of claim 21 wherein the conduit is sealed to fluids at its lower extremity.

24. The method of claim 21 wherein said openings in the conduit are perforations.

25. The method of claim 21 wherein said openings in the conduit are lateral extensions from the conduit.

26. A method for gravel packing a well that penetrates an unconsolidated or poorly consolidated subterranean oil or gas reservoir, comprising:

(a) providing a wellbore through said reservoir;

(b) locating a sand screen inside the wellbore and in juxtaposition with said wellbore, an annulus being formed between said sand screen and said wellbore;

(c) positioning a conduit in juxtaposition with said sand screen extending substantially the length of said sand screen and having its lower extremity open to fluids, said conduit having openings at preselected intervals throughout a substantial portion of the conduit to establish fluid communication between the conduit and said annulus;

(d) injecting a fluid slurry containing gravel down the well and up through said annulus and conduit whereby the fluid portion of the slurry is forced out of said annulus into said reservoir and the gravel portion of the slurry is deposited in said annulus;

(e) sizing the cross-sectional area of said conduit and said annulus so that if gravel forms a bridge in a portion of said annulus thereby blocking the flow of fluid slurry through the said annulus, fluid slurry containing gravel will continue to flow through the conduit and into the annulus around the gravel bridge; and (f) terminating the injection of said fluid slurry containing gravel when the said annulus is completely packed with gravel.

27. The method of claim 26 wherein a plurality of conduits are attached to the sand screen.

28. The method of claim 26 wherein said openings in the conduit are perforations.

29. The method of claim 26 wherein said openings in the conduit are lateral extensions from the conduit.

30. The method of claim 26 wherein the conduit is sealed at its upper extremity.

31. A method for gravel packing a well that penetrates an unconsolidated or poorly consolidated subterranean oil or gas reservoir, comprising:

(a) providing a wellbore through said reservoir;

(b) locating a sand screen inside the wellbore and in juxtaposition with said wellbore, an annulus being formed between said sand screen and said wellbore;

(c) positioning a conduit in juxtaposition with said sand screen extending substantially the length of said sand screen and having its upper extremity open to fluids, said conduit having openings at preselected intervals throughout a substantial portion of the conduit to establish fluid communication between the conduit and said annulus;

(d) injecting a fluid slurry containing gravel down through said conduit whereby the fluid portion of the slurry is forced out of said annulus into said reservoir and the gravel portion of the slurry is deposited in said annulus; and (e) terminating the injection of said fluid slurry containing gravel when the said annulus is completely packed with gravel.

32. The method of claim 31 wherein a plurality of conduits are attached to the sand screen.

33. The method of claim 31 wherein the conduit is sealed to fluids at its lower extremity.

34. The method of claim 31 wherein said openings in the conduit are perforations.

35. The method of claim 31 wherein said openings in the conduit are lateral extensions from the conduit.

36. A method for gravel packing a well that penetrates an unconsolidated or poorly consolidated subterranean oil or gas reservoir, comprising:

(a) providing a wellbore through said reservoir;

(b) locating a sand screen inside the wellbore and in juxtaposition with said wellbore, an annulus being formed between said sand screen and said wellbore;

(c) positioning a conduit in juxtaposition with said sand screen extending substantially the length of said sand screen and having its lower extremity open to fluids, said conduit having openings at preselected intervals throughout a substantial portion of the conduit to establish fluid communication between the conduit and said annulus;

(d) injecting a fluid slurry containing gravel down the well and up through said conduit whereby the fluid portion of the slurry is forced out of said annulus into said reservoir and the gravel portion of the slurry is deposited in said annulus from the top to the bottom; and (e) terminating the injection of said fluid slurry containing gravel when said annulus is completely packed with gravel.

37. The method of claim 36 wherein a plurality of conduits are attached to the sand screen.

38. The method of claim 36 wherein the conduit is sealed to fluids at its upper extremity.

39. The method of claim 36 wherein said openings in the conduit are perforations.

40. The method of claim 37 wherein said openings in the conduit are lateral extensions from the conduit.

* * * * *